US007001317B2

(12) United States Patent
Marcotte

(10) Patent No.: US 7,001,317 B2
(45) Date of Patent: Feb. 21, 2006

(54) KEGEL MUSCLE EXERCISING DEVICE AND METHOD FOR EXERCISING KEGEL MUSCLE

(76) Inventor: Jean-Claude Marcotte, P.O. Box 141, Station B, Sudbury, Ontario (CA) P34 4N5

( * ) Notice: Subject to any disclaimer, the term of this patent is extended or adjusted under 35 U.S.C. 154(b) by 0 days.

(21) Appl. No.: 10/720,545

(22) Filed: Nov. 24, 2003

(65) Prior Publication Data

US 2005/0113228 A1 May 26, 2005

(51) Int. Cl.
*A63B 71/00* (2006.01)

(52) U.S. Cl. ..... 482/148; 482/49; 128/833

(58) Field of Classification Search ..... 482/148, 482/44, 49; 128/833, 835, 830, 834, 838, 128/840, 778, 774, 842, 831, DIG. 5, 885; 600/38

See application file for complete search history.

(56) References Cited

U.S. PATENT DOCUMENTS

| | | | | | |
|---|---|---|---|---|---|
| 21,189 | A | * | 8/1858 | Elmer | 128/834 |
| 235,959 | A | * | 12/1880 | Otto | 128/834 |
| 328,553 | A | * | 10/1885 | Warmoth | 128/834 |
| 1,615,728 | A | * | 1/1927 | Smith | 128/834 |
| 2,574,767 | A | * | 11/1951 | Stubbs | 128/834 |
| 3,831,587 | A | | 8/1974 | Boyd | |
| 3,971,367 | A | * | 7/1976 | Zaffaroni | 128/833 |
| 4,050,449 | A | | 9/1977 | Castellana et al. | |
| 4,571,791 | A | * | 2/1986 | Ceresko | 27/19 |
| 4,574,791 | A | | 3/1986 | Mitchener | |
| 4,932,397 | A | | 6/1990 | McFaul, Sr. | |
| D336,959 | S | | 6/1993 | Liming | |
| 5,690,603 | A | | 11/1997 | Kain | |
| D403,431 | S | | 12/1998 | Gladieux, Jr. | |
| 5,853,362 | A | * | 12/1998 | Jacobs | 600/38 |
| D405,536 | S | | 2/1999 | Haynes | |
| 5,931,775 | A | | 8/1999 | Smith | |
| D447,235 | S | | 8/2001 | Stein | |
| D447,562 | S | | 9/2001 | Stein | |
| D456,909 | S | | 5/2002 | Szabo | |
| 6,406,411 | B1 | | 6/2002 | Guagliano et al. | |
| 6,444,224 | B1 | | 9/2002 | Rathbone et al. | |
| D475,793 | S | | 6/2003 | Tinsley | |
| 2003/0036464 | A1 | | 2/2003 | Zavilevich | |
| 2003/0097041 | A1 | * | 5/2003 | Ritchie et al. | |
| 2003/0104909 | A1 | * | 6/2003 | Teran | |

* cited by examiner

*Primary Examiner*—Gregory L. Huson
*Assistant Examiner*—L. Amerson
(74) *Attorney, Agent, or Firm*—Seyfarth Shaw LLP

(57) ABSTRACT

The Kegel exercising device and method for exercising the Kegel muscle may be employed by a female to prevent incontinence, enhance sensitivity during sexual activity and improve genital health. The Kegel exercising device has two spheres respectively for insertion into the vaginal and anal cavities, and an intermediate curved portion which provides resistance against the front wall and the back wall of the Kegel muscle simultaneously. The device of the current invention thus permits a user to exercise the Kegel muscle without having to manipulate the device with her hands.

3 Claims, 2 Drawing Sheets

KEGEL MUSCLE EXERCISING DEVICE AND METHOD FOR EXERCISING KEGEL MUSCLE

FIELD OF THE INVENTION

The present invention relates to a device and method for exercising the Kegel muscle of a female.

BACKGROUND OF THE INVENTION

Exercise of the Kegel muscle may help to alleviate the problem of urinary incontinence in women. Urinary incontinence in women may be caused by pregnancy and childbirth, menopause, neurologic injury, birth defects or other physical problems. Ultimately, incontinence is caused by problems with muscles that help to hold or release urine. These muscles support the urethra, bladder, uterus and rectum and are known informally as pelvic floor muscles. More formal terms for these muscles include perineal muscles, sphincter muscles and pubococcygeus or Kegel muscles.

One can strengthen the Kegel muscle, which in turn leads to little or no unintended urine loss for many women. Other benefits of strengthening the Kegel muscle include enhanced sensitivity and stimulation during sexual activity and overall improved genital health.

Other devices for exercising the muscles in question have been previously disclosed. Examples of such devices include U.S. Pat. No. 4,050,449 (Castellana et al.), U.S. Pat. No. 4,574,791 (Mitchener), U.S. Pat. No. 5,931,775 (Smith), U.S. Design Pat. No. D447,235 (Stein), U.S. Design Pat. No. D447,562 (Stein), U.S. Pat. No. 6,406,411 B1 (Guagliano et al.) and U.S. Patent Application Serial No. 2003/0036464 A1 (Zavilevich).

The prior art muscle exercising devices taught in these references suffer from one or more drawbacks. Some require manipulation by the user's hands during exercise. Furthermore, none of the prior art Kegel exercising devices are constructed so as to surround the Kegel muscle and thus apply resistance to its front wall and back wall simultaneously. Also, none of the prior art Kegel exercising devices are constructed to evoke sexual stimulation when inserted into the vaginal cavity. Moreover, many of the prior art Kegel exercising devices are not designed to remain in place for long periods of time while the user is attending to other tasks. Finally, the prior art Kegel exercising devices are complicated and have moving parts, thus making them more expensive and causing potential for breakage and injury to the user.

Prior art Kegel muscle exercising devices are also not ergonomically constructed so as to maximize comfort when applied. Prior art massage devices previously disclosed are ergonomically constructed but are not meant to be used to exercise pelvic muscles. Such devices include those disclosed in U.S. Design Pat. No. 336,959 (Liming), U.S. Design Pat. No. 403,431 (Gladieux, Jr.), U.S. Design Pat. No. 405,536 (Haynes), U.S. Design Pat. No. D456,909 (Szabo) and U.S. Design Pat. No. D475,793 (Tinsley).

SUMMARY OF THE INVENTION

It is thus an object of the present invention to provide an improved Kegel muscle exercising device of simple construction and which is uniquely positioned upon application to maximize the effects of Kegel exercises. Furthermore, it is an object of the present invention to provide a Kegel exercising device that does not require manipulation with the hands while in use and which may be worn and used while performing other tasks. It is also an object of the present invention to provide a Kegel muscle exercising device which is comfortable when applied and which may provide sexual stimulation when in use. Finally, it is an object of the present invention to provide a method of exercising the Kegel muscle.

In order to achieve these objects, in accordance with the present invention, there is provided a device for exercising the Kegel muscle of a female and enhancing sexual stimulation. The device has a first rounded end for insertion into the female's vaginal cavity and a second rounded end for insertion into the same female's anal cavity. The device also has an curved intermediate portion connecting the first rounded end to the second rounded end and configured in a manner such that the first rounded end and the second rounded end lie in a same plane and are spaced from each other such that the second rounded end may be concurrently inserted into the anal cavity after the first rounded end has been inserted concurrently into the vaginal cavity. The curved intermediate portion has a fulcrum which bears against the front wall and the back wall of the Kegel muscle.

In a preferred embodiment of the present invention the first rounded end comprises a first sphere and the second rounded end comprises a second larger sphere. The fulcrum is positioned proximate to the second sphere and the curved intermediate portion also has an arc positioned proximate to the first sphere.

The invention further provides a method for exercising the Kegel muscle of a female. The first step of this method is to insert a first rounded end of a device into the vaginal cavity. A second rounded end of the device is then inserted into the anal cavity so that an intermediate portion of the device bears against the front wall and the back wall of the Kegel muscle. Once the device is fully inserted, the sphincter muscle is contracted so as to draw the second rounded end further into the anal cavity and press the first rounded end against the pubic bone.

BRIEF DESCRIPTION OF THE DRAWINGS

These and other advantages of the invention will become apparent upon reading the following detailed description and upon referring to the drawings in which.

These and other advantages of the invention will become apparent upon reading the following detailed description and upon referring to the drawings in which.

While the invention will be described in conjunction with the illustrative embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

Figure 1:
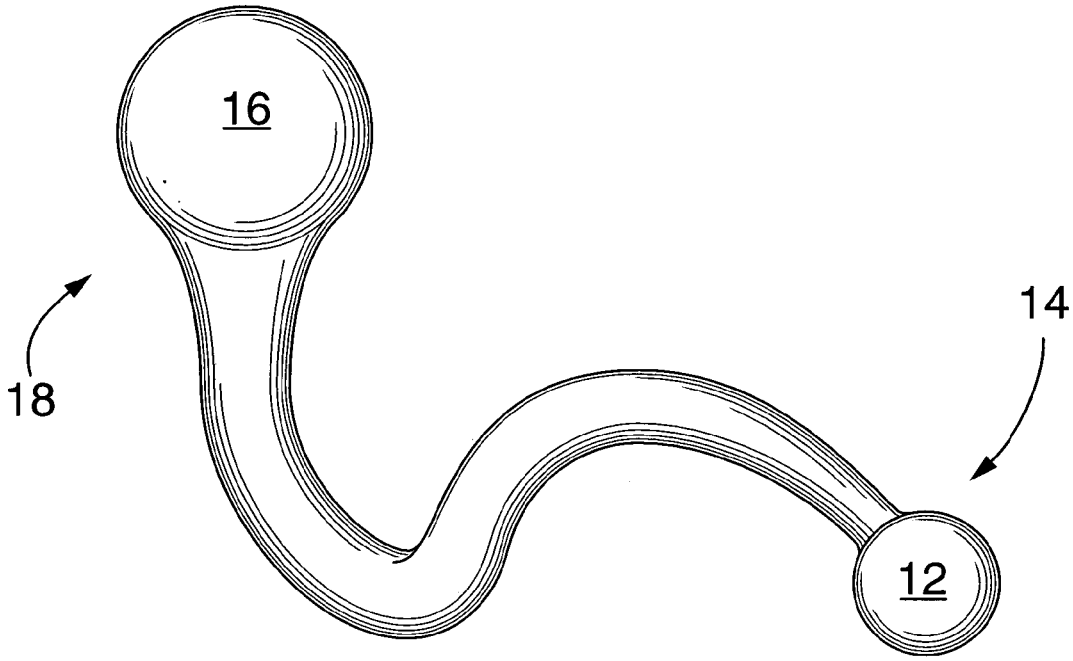
FIG. 1 is a perspective view of the Kegel muscle exercising device of the present invention.
Figure 2:
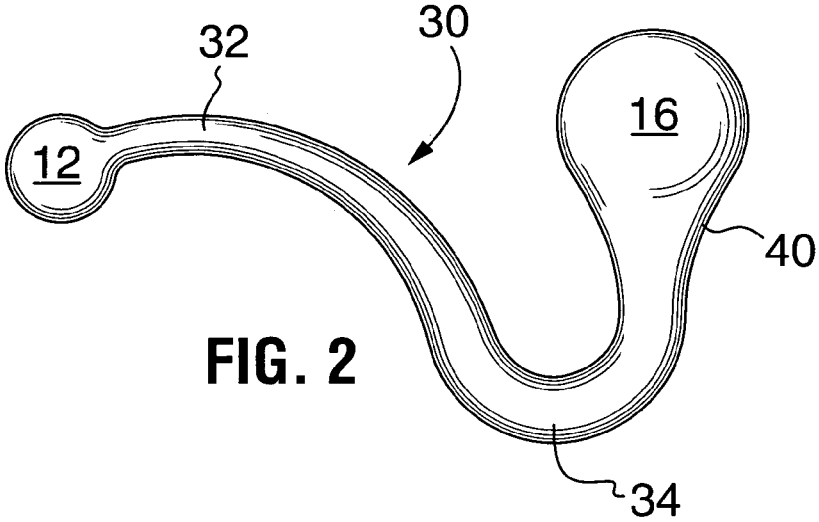
FIG. 2 is a side plan view of the Kegel muscle exercising device of the present invention.
Figure 3:
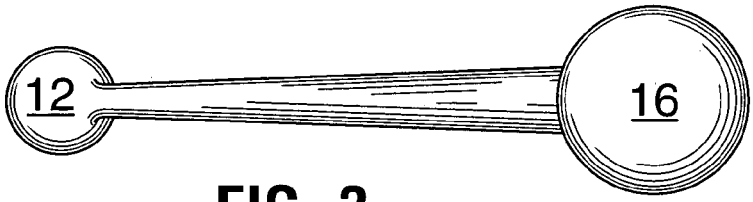
FIG. 3 is a top plan view of the Kegel muscle exercising device of the present invention.

In the following description, similar features in the drawings have been given similar reference numerals. FIG. 1 shows a device for exercising the Kegel muscle 10. The device 10 has a first sphere 12 at a first end 14 and a second sphere 16 at a second end 18.

An intermediate portion 30 of circular cross-section connects the first end 14 to the second end 18. The intermediate portion 30 has an arc 32 proximate to the first end 14 and a fulcrum 34 proximate to the second end 18. The arc 32 has a broad curvature while the fulcrum 34 has a tight curvature such that it is U-shaped. The arc 32 and the fulcrum 34 are bowed in opposite directions such that they combine to make the intermediate portion 30 somewhat S-shaped.

The intermediate portion 30 is gradually tapered along its length. Thus the circumference of the intermediate portion 30 near the second end 18 is greater than the circumference of the intermediate portion 30 near the first end 16. Preferably, the diameter near the second end 18 is ⅜ of an inch and the diameter near the first end 16 is 7⁄32 of an inch.

The second sphere 16 extends progressively to the intermediate portion 30 along taper 40. Preferably, the distance from the center of the second sphere 16 to the end of the taper 40 is 1.08 inches. Experimentation has shown that the distance from the center of the second sphere 16 to the end of the taper 40 may be extended to a maximum of 1.33 inches.

There is preferably little or no such taper between the first sphere 12 and the intermediate portion 30 such that the attachment point of the first sphere 12 to the intermediate portion 30 is better defined than the tapered attachment of the second sphere 16 to the intermediate portion 30.

A preferred embodiment of the device 10 is cast from surgical steel and is a fully integral one piece object. Furthermore, the preferred embodiment of the device 10 has a completely smooth surface without seams or other imperfections.

The first sphere 12, the second sphere 16 and the intermediate portion 30 lie in the same plane. Preferably the device 10 is perfectly symmetrical such that the plane bisects the device 10.

Figure 4:
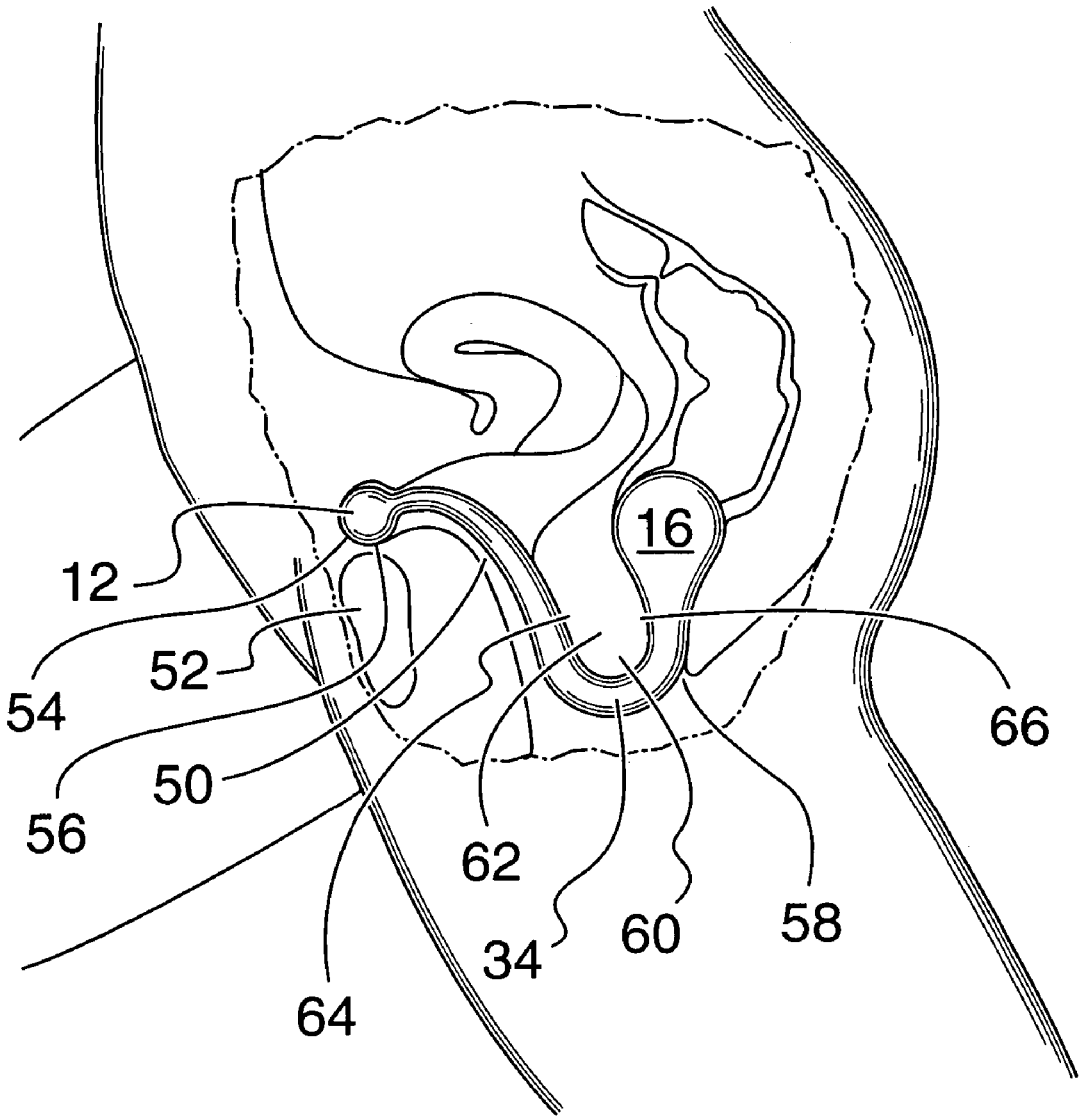
FIG. 4 is a sectional view of the pelvic region of a female body into which the Kegel muscle exercising device of the present invention has been inserted.

The device 10 is shown in use in FIG. 4. In operation, the device 10 is held by the user at or near the fulcrum 34. The first sphere 12 is inserted into the vaginal cavity 50 and guided along the profile of the pubic bone 52 until it rests on top of the pubic bone 52 against or close to the anterior vaginal wall 54. In this position, the first sphere 12 is also close to the Graphenburg spot 56. Moderate pressure by the first sphere 12 against the pubic bone 52 indicates that the second sphere 16 is aligned for insertion info the anal cavity 58. The sphincter muscle 60 is relaxed and moderate pressure is applied upward upon the fulcrum 34 so that the second sphere 16 may be inserted into the anal cavity 58. The distance between the center of the first sphere 12 and the center of the second sphere 16 permits the user to insert the second sphere 16 into the anal cavity 58 comfortably when the first sphere 12 is in place in the vaginal cavity 50. Preferably, this distance is 3.4 inches. When the device 10 is in position, the fulcrum 34 surrounds the Kegel muscle 62 and provides resistance to both the front wall 64 and the back wall 66 of the Kegel muscle 62.

When in position, a portion of the fulcrum 34 is outside of the user's body. However, because the fulcrum 34 fits tightly about Kegel muscle 62, the device 10 may be worn under clothing while its user undertakes other tasks. The fit of the fulcrum 34 around the Kegel muscle 62 also permits the user of the device 10 to exercise the Kegel muscle 62 by contracting the sphincter muscle 60. This contraction draws the second sphere 16 inward such that the first sphere 12 presses downwards upon the pubic bone 52 and the Graphenburg spot 56. Thus, in addition to exercising the Kegel muscle 62, this action provides sexual stimulation to the user and encourages continued exercise. Furthermore, the device 10, once inserted, is operated without the user having to manipulate the device 10 with her hands. The second sphere 16 must have a diameter that permits the user to manipulate the device 10 by drawing the second sphere 16 further into the anal cavity 58 by contracting the sphincter muscle 60. Preferably, the diameter of the second sphere 16 is 1.1 inches. Furthermore, the first sphere 12 must have a diameter such that pressure is localized upon the Graphenburg spot 56 when the sphincter muscle 60 is contracted. Preferably, the diameter of the first sphere 12 is ⅝ of an inch. The relative sizes of the first sphere 12 and the second sphere 16 along with the position of the spheres relative to the fulcrum 34 distribute the mass of device 10 evenly about the fulcrum 34.

Thus, it is apparent that there has been provided in accordance with the invention a KEGEL MUSCLE EXERCISING DEVICE AND METHOD FOR EXERCISING KEGEL MUSCLE that fully satisfies the objects, aims and advantages set forth above. While the invention has been described in conjunction with specific embodiments thereof, it is that many alternatives, modifications and variations will be apparent to those skilled in light of the foregoing description. Accordingly, it is intended to embrace all such alternatives, modifications and variations as fall within the spirit and broad scope of the invention.

What is claimed is:

1. A method for exercising the Kegel muscle of a female comprising:

inserting a first rounded end of a device into the female's vaginal cavity;

inserting a second rounded end of the device into the female's anal cavity such that an intermediate portion of the device bears against the front wall and the back wall of the Kegel muscle; and contracting the sphincter muscle so as to draw the second rounded end further into the anal cavity and thereby press the first rounded end against the pubic bone.

2. The method of claim 1 wherein the first rounded end of the device rests upon the anterior vaginal wall above the pubic bone when inserted.

3. The method of claim 1 wherein the first rounded end of the device rests against the anterior vaginal wall and on top of the pubic bone when inserted.

* * * * *

UNITED STATES PATENT AND TRADEMARK OFFICE

CERTIFICATE OF CORRECTION

PATENT NO. : 7,001,317 B2 
APPLICATION NO. : 10/720545
DATED : February 21, 2006
INVENTOR(S) : Jean-Claude Marcotte It is certified that error appears in the above-identified patent and that said Letters Patent is hereby corrected as shown below:

Title page,
Item [56], References Cited, OTHER PUBLICATIONS, add:
-- Urinary Incontinence in Women" online: National Kidney and Urologic Diseases Information Clearinghouse;
http://kidney.niddk.nih.gov/kudiseases/pubs/iowomen/index.htm (published: May 2002) --.

Signed and Sealed this

Twentieth Day of June, 2006

JON W. DUDAS
*Director of the United States Patent and Trademark Office*